US008882211B2

(12) United States Patent
Jang et al.

(10) Patent No.: US 8,882,211 B2
(45) Date of Patent: Nov. 11, 2014

(54) REFRIGERATOR

(71) Applicant: Samsung Electronics Co., Ltd., Suwon-si (KR)

(72) Inventors: Myoung Jin Jang, Gwangju (KR); Chul Woo Kim, Hwaseong (KR); Sung Cheul Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 3 days.

(21) Appl. No.: 13/648,683

(22) Filed: Oct. 10, 2012

(65) Prior Publication Data

US 2013/0278126 A1 Oct. 24, 2013

(30) Foreign Application Priority Data

Oct. 13, 2011 (KR) ..... 10-2001-0104863

(51) Int. Cl.

| | |
|---|---|
| ***F25D 25/00*** | (2006.01) |
| ***F25D 25/02*** | (2006.01) |
| ***F25D 23/00*** | (2006.01) |
| ***F25D 23/02*** | (2006.01) |

(52) U.S. Cl.

CPC ..... *F25D 23/02* (2013.01); *F25D 25/021* (2013.01); *F25D 23/00* (2013.01); *F25D 25/025* (2013.01)

USPC ..... 312/404; 312/408; 312/334.7

(58) Field of Classification Search

CPC ..... A47B 2210/17; A47B 2210/175; F25D 23/04; F25D 23/00; F25D 23/025

USPC ..... 312/401, 402, 404, 406, 408, 330.1, 312/334.1, 334.7, 334.8

See application file for complete search history.

(56) References Cited

U.S. PATENT DOCUMENTS

| | | | | |
|---|---|---|---|---|
| 5,484,198 | A * | 1/1996 | Pilliod | 312/334.18 |
| 5,820,239 | A * | 10/1998 | Christenson et al. | 312/334.23 |
| 6,394,567 | B1 * | 5/2002 | Welch | 312/334.41 |
| 6,626,509 | B2 * | 9/2003 | Remmers | 312/334.7 |
| 7,712,852 | B2 * | 5/2010 | Choi et al. | 312/402 |
| 7,883,163 | B2 * | 2/2011 | Dorner et al. | 312/404 |
| 2005/0156494 | A1 * | 7/2005 | Bergmann et al. | 312/404 |
| 2006/0192469 | A1 * | 8/2006 | Koo | 312/330.1 |
| 2009/0066207 | A1 * | 3/2009 | Laible | 312/404 |
| 2009/0309472 | A1 * | 12/2009 | Park et al. | 312/401 |
| 2011/0018414 | A1 * | 1/2011 | Kim et al. | 312/402 |
| 2013/0257254 | A1 * | 10/2013 | Austin et al. | 312/404 |

FOREIGN PATENT DOCUMENTS

| | | |
|---|---|---|
| JP | 2009-52801 | 3/2009 |
| KR | 1999-012380 | 4/1999 |

* cited by examiner

*Primary Examiner* — Daniel Rohrhoff
(74) *Attorney, Agent, or Firm* — Staas & Halsey LLP

(57) ABSTRACT

A refrigerator having an improved structure of a storage box and a shelf thereof so as to achieve increased space utilization of a storage compartment. The storage box may have slide protrusions respectively formed on both of outer side-faces of the storage box at a lower portion thereof to allow the storage box to be slidably retracted in or extended from the storage compartment. The shelf may have a support structure to support food thereon and slide grooves respectively formed above both sides of the support structure, each groove receiving the corresponding slide protrusion of the storage box. When the storage box is mounted on the shelf, food may be put in the inner space of the storage box, whereas when the storage box is dismounted from the shelf, a food storage space may be present on the support structure of the shelf.

10 Claims, 11 Drawing Sheets

REFRIGERATOR

CROSS-REFERENCE TO RELATED APPLICATIONS

This application claims the benefit of Korean Patent Application No. 2011-0104863, filed on Oct. 13, 2011 in the Korean Intellectual Property Office, the disclosure of which is incorporated herein by reference.

BACKGROUND

1. Field

Embodiments of the present disclosure relate to a refrigerator having improved structures of a storage box and a shelf thereof so as to achieve an optimized storage space of a storage compartment and, at the same time, maximum prevention of cool air leakage.

2. Description of the Related Art

Generally, a refrigerator includes a storage chamber to store food therein and a cool air supply device to supply cool air into the storage chamber, to thereby keep food in a fresh state.

In the storage chamber, each of shelves to seat food thereon is disposed in a horizontal manner. The storage chamber is divided into a plurality of storage compartments by the shelves. A storage box for preventing moisture evaporation and cool air leakage is disposed in the storage chamber to receive food therein.

Conventionally, the storage box has slide protrusions respectively formed on both outer side-faces of the storage box at an upper portion thereof. Fixed grooves are respectively formed at inner side-faces of the storage chamber in a corresponding manner to the slide protrusions. Thus, the storage box slides in the storage chamber toward a retracted position or extended position.

SUMMARY

Therefore, it is an aspect of the present disclosure to provide a refrigerator having improved structures of a storage box and a shelf thereof so as to achieve increased space utilization of a storage compartment.

It is another aspect of the present disclosure to provide a refrigerator to achieve maximum prevention of cool air leakage.

Additional aspects of the disclosure will be set forth in part in the description which follows and, in part, will be apparent from the description, or may be learned by practice of the disclosure.

In accordance with one aspect of the present disclosure, a refrigerator may include a body, a storage compartment defined in the body, a door pivotally coupled to the body so as to open or close an open front of the storage compartment, a storage box having an inner space to store food, and a shelf having a support structure to support food thereon. The storage box may have slide protrusions respectively formed on both of outer side-faces of the storage box at a lower portion thereof to allow the storage box to be slidably retracted in or extended from the storage compartment. The shelf may have slide grooves respectively formed above both sides of the support structure, each groove receiving the corresponding slide protrusion of the storage box, so that the storage box is able to be slidably mounted on or dismounted from the frames of the shelf. When the storage box is mounted on the frames of the shelf, food may be put in the inner space of the storage box, that is, a food storage space may be present in the inner space of the storage box, whereas when the storage box is dismounted from the frames of the shelf, food may be put on the support structure of the shelf, that is, a food storage space may be present on the support structure of the shelf.

Each of both side walls of the storage box may have a first wall portion and a second wall portion disposed under the first wall portion with a bent portion formed therebetween so that the second wall portion is disposed at a more inner position in the storage box than the first wall portion. Each of the slide protrusions of the storage box may be formed on the outer side-face of the second wall portion.

Each of the slide protrusions of the storage box may have at least one of a first inclined portion to allow the storage box to move downward as the storage box moves toward a retracted position in the storage compartment, and a second inclined portion to allow the storage box to move downward as the storage box moves toward an extended position from the storage compartment.

The first inclined portion may incline downward from a front side of the storage box to a rear side thereof, while the second inclined portion may incline upward from a front side of the storage box to a rear side thereof.

The first inclined portion may form a front portion of the slide protrusion, while the second inclined portion may form a rear portion of the slide protrusion.

Each of the slide protrusions of the storage box may include a first stopper formed at a front end thereof so as to interfere with a roller installed at the shelf to limit a retracted distance of the storage box.

Each of the slide protrusions of the storage box may include a round portion to prevent the storage box from shaking after the storage box is brought into a maximum-retracted position in the storage compartment.

Each of the slide protrusions of the storage box may include a second stopper formed at a rear end thereof so as to interfere with a roller installed at the shelf to limit an extended distance of the storage box.

The storage box may include a front wall, a rear wall, both side walls, and a bottom, and the front wall, rear wall, both side walls, and bottom may be formed to be integrated with one another using injection molding.

The shelf may be seated and supported on a pair of supports respectively provided at both sides of an inner case of the storage compartment.

In accordance with another aspect of the present disclosure, a refrigerator may include a body, a storage compartment defined in the body, a door pivotally coupled to the body so as to open or close an open front of the storage compartment, a storage box having an inner space to store food, and a shelf having a support structure to support food thereon. The storage box may have slide protrusions respectively formed on both of outer side-faces of the storage box at a lower portion thereof to allow the storage box to be slidably retracted in or extended from the storage compartment. Protrusion-receiving units may be respectively provided on both inner side-faces of the storage compartment to respectively receive the slide protrusions of the storage box. Each of the slide protrusions of the storage box may have at least one of a first inclined portion to allow the storage box to move downward as the storage box moves toward a retracted position in the storage compartment, and a second inclined portion to allow the storage box to move downward as the storage box moves toward an extended position from the storage compartment.

In accordance with another aspect of the present disclosure, a refrigerator may include a body, a storage chamber defined in the body, a door pivotally coupled to the body so as to open or close an open front of the storage chamber, at least one of a shelf having a support structure to support food thereon and horizontally disposed in the storage chamber so as to vertically divide the storage chamber into a plurality of storage compartments, a cool air cover pivotally coupled to a front having an open portion of at least one of the storage compartments to prevent cool air leakage, a storage box disposed in each of remaining storage compartments and having slide protrusions respectively formed on both outer side-faces of the storage box at a lower portion thereof to allow the storage box to be slidably retracted in or extended from the storage compartment. The shelf may have slide grooves respectively formed above both sides of the support structure, each groove receiving the corresponding slide protrusion of the storage box. Each of the slide protrusions of the storage box may have at least one of a first inclined portion to allow the storage box to move downward as the storage box moves toward a retracted position in the storage compartment, and a second inclined portion to allow the storage box to move downward as the storage box moves toward an extended position from the storage compartment.

A front wall of the storage box may have an area substantially equal to an area of the front of the corresponding storage compartment so as to prevent cool air in the corresponding storage compartment from being discharged to the outside.

The rear wall of the storage box may have an open portion to allow cool air to flow into the inner space of the storage box.

The cool air cover may be installed at the storage compartment in which the storage box is not disposed.

The cool air cover may be installed at the storage compartment above the storage chamber in which the storage box is disposed.

The various embodiments of the disclosure have the following effects. Using the configuration in which the slide protrusions are respectively formed on both outer side-faces of the storage box at a lower portion thereof and the corresponding slide grooves are respectively formed above both sides of the shelf, food may be put in the inner space of the storage box when the storage box is mounted on the shelf, whereas food may be put on the support structure of the shelf when the storage box is dismounted from the shelf, thereby achieving various uses for the storage compartment.

Since the second wall portion of the storage box on which the slide protrusion of the storage box is formed is disposed at a more inner position in the storage box than the first wall portion, the storage box may have a larger storage volume compared to a conventional storage box in which a slide protrusion is formed on a side wall having an overall flat surface.

Since the cool air covers are respectively installed at some of the plurality of the storage compartment and the storage boxes are respectively disposed in the other of the plurality of the storage compartment and further the front wall of each of the storage boxes has an area substantially equal to an area of the front of the corresponding storage compartment, cool air in the corresponding storage compartment may be effectively prevented from being discharged to the outside.

Moreover, the inclined portions of the slide protrusion of the storage box are configured such that, once the storage box reaches the predetermined retracted or extended position during retraction or extension of the storage box, the direction of subsequent movement of the storage box matches with the direction of the force of gravity. This may ease drawing or pushing of the storage box.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
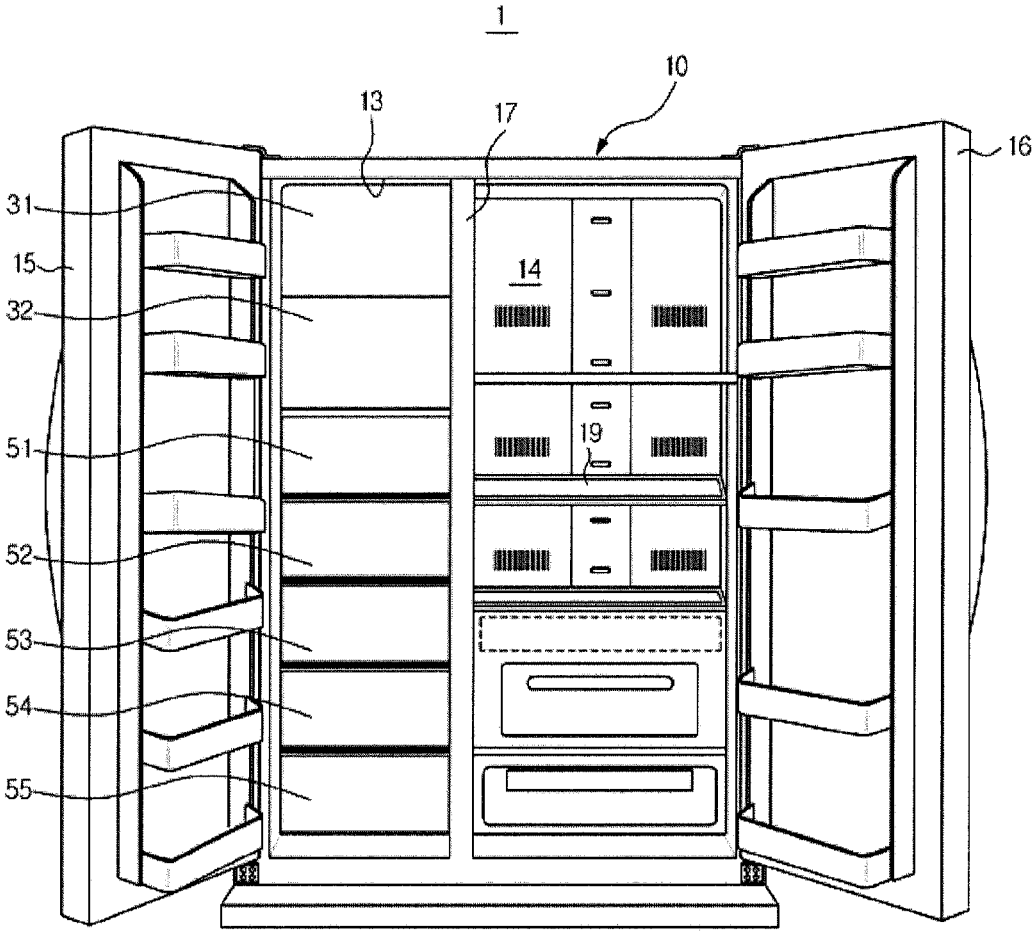
FIG. 1 is a front elevation view illustrating an appearance of a refrigerator according to one embodiment of the present disclosure.

Reference will now be made in detail to the embodiments of the present disclosure, examples of which are illustrated in the accompanying drawings, wherein like reference numerals refer to like elements throughout.

Below, a refrigerator according to one embodiment of the present disclosure will be described in detail with reference to the accompanying drawings.

Figure 2:
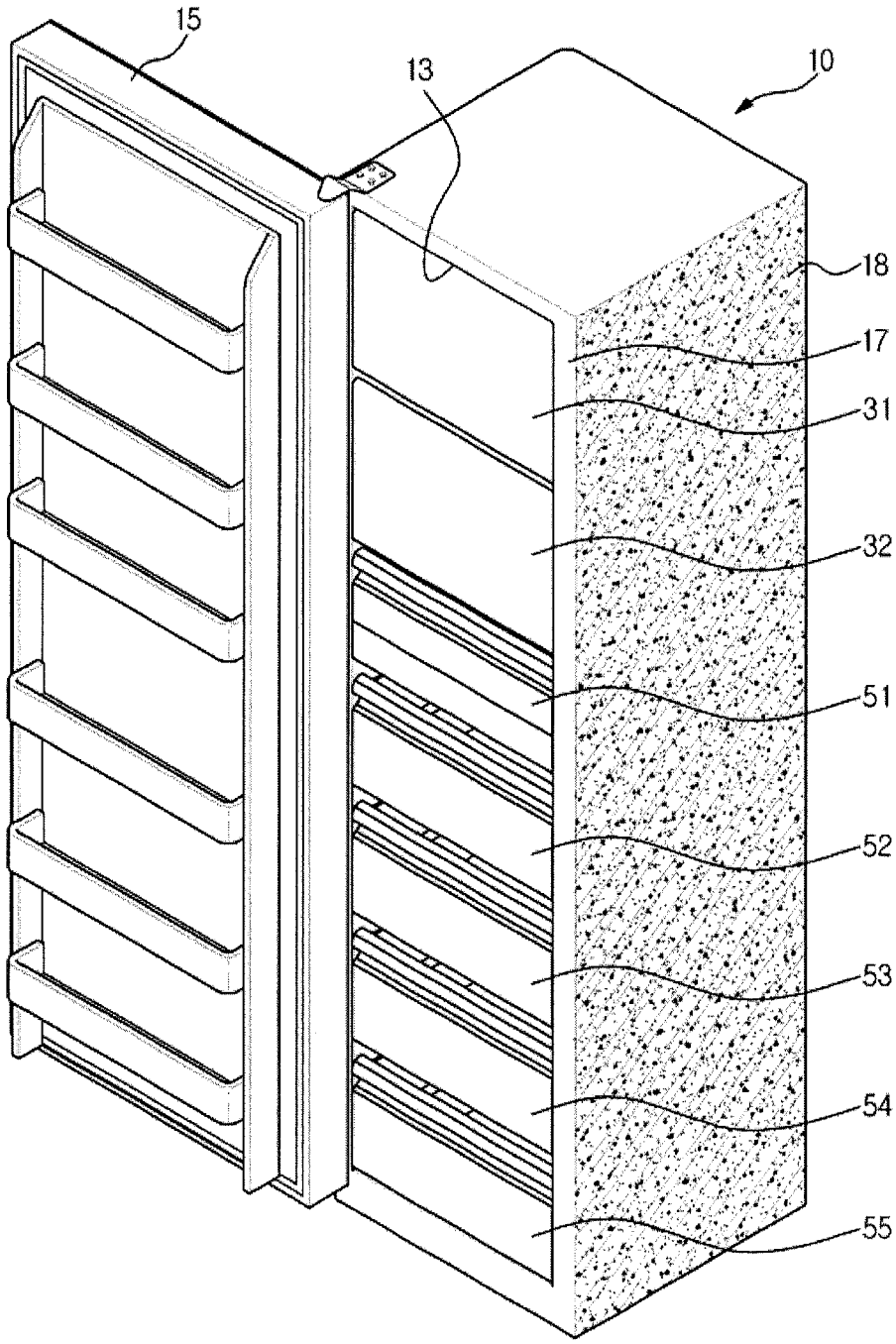
FIG. 2 is an exploded view of a first storage chamber of the refrigerator according to one embodiment of the present disclosure.
Figure 3:
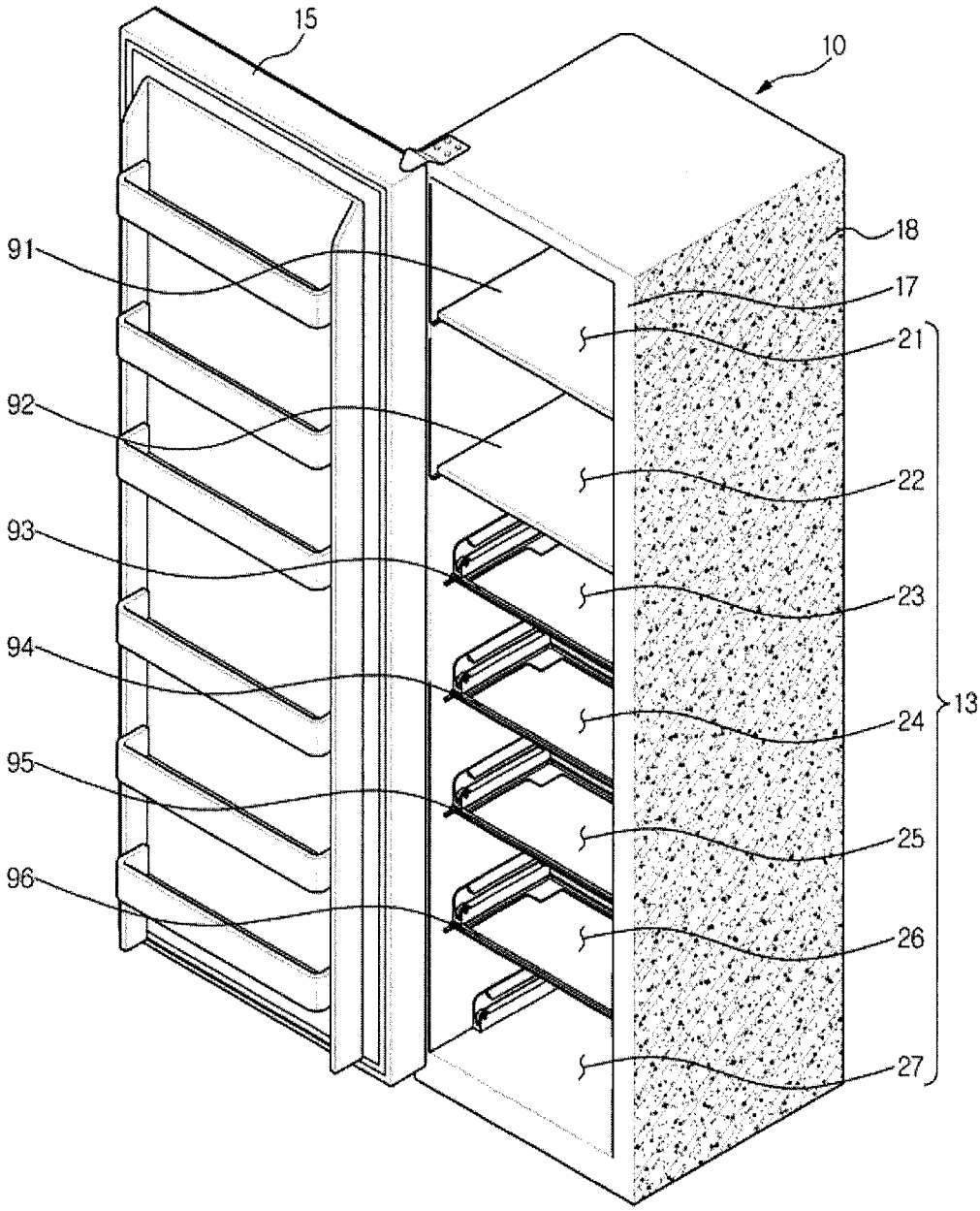
FIG. 3 is a perspective view illustrating a state in which cool air covers and storage boxes are removed from the refrigerator according to one embodiment of the present disclosure.

FIG. 1 is a front elevation view illustrating an appearance of a refrigerator according to one embodiment of the present disclosure. FIG. 2 is an exploded view of a first storage chamber of the refrigerator according to one embodiment of the present disclosure. FIG. 3 is a perspective view illustrating a state in which cool air covers and storage boxes are removed from the refrigerator according to one embodiment of the present disclosure.

Referring to FIG. 1 to FIG. 3, the refrigerator 1 according to one embodiment of the present disclosure may include a body 10, storage chambers 13 and 14 defined in the body 10 to store food, and a cool air supply device (not shown) to supply cool air to each of the storage chambers 13 and 14.

The body 10 may include an inner case to form the storage chambers 13 and 14, an outer case to form an appearance of the refrigerator 1, and a foam heat insulator 18 (refer to FIG. 2) disposed between the inner and outer cases to prevent cool air in each of the storage chambers 13 and 14 from being discharged to the outside thereof.

The storage chambers may include a first storage chamber 13 and a second storage chamber 14 which are separated from each other via a vertical partition wall 17. The first storage chamber 13 disposed at a left side of the vertical partition wall 17 may be a refrigeration chamber, while the second storage chamber 14 disposed at a right side of the vertical partition wall 17 may be a freezer chamber.

Doors 15 and 16 are pivotally coupled to the body 10 so as to respectively open/close the storage chambers 13 and 14 at fronts thereof. Each of the doors 15 and 16 may be pivotally coupled to the body 10 via upper and lower hinges. In the storage chamber 14, one or more shelves 19 may be disposed to store food thereon.

The storage chamber 13 may be divided into a plurality of storage compartments via at least one shelf. In the refrigerator 1 according to one embodiment of the present disclosure as shown in FIG. 1 to FIG. 3, the storage chamber 13 is divided into seven storage compartments 21, 22, 23, 24, 25, 26 and 27 via six shelves 91, 92, 93, 94, 95 and 96. Different numbers of the shelves and the storage compartments may be possible.

Among the six shelves 91, 92, 93, 94, 95 and 96, each of the uppermost shelf 91 and the second uppermost shelf 92 has a simple flat support structure, while each of the other shelves 93, 94, 95 and 96 disposed thereunder has a flat support structure, and left and right protrusion-receiving shelf portions 105 (refer to FIG. 10) respectively extending upwards from left and right sides of the flat support structure. Details of the protrusion-receiving portions 105 will be described later.

As shown in FIGS. 2 and 3, each of cool air covers 31 and 32 is rotatably coupled to the open front portion of each of the uppermost storage compartment 21 and the second uppermost storage compartment 22 so as to prevent cool air within the storage compartments 21 and 22 from being discharged to the outside thereof. That is, each of cool air covers 31 and 32 has an area substantially equal to an area of the front of each of the storage compartments 21 and 22, thereby preventing cool air within the storage compartments 21 and 22 from being discharged to the outside thereof.

Storage boxes 51, 52, 53, 54 and 55 are respectively provided in the five remaining storage compartments 23, 24, 25, 26 and 27. Each of the storage boxes 51, 52, 53, 54 and 55 may store food therein and may be slidably retracted or extended into or out of the corresponding storage compartment 23, 24, 25, 26 or 27.

Figure 4:
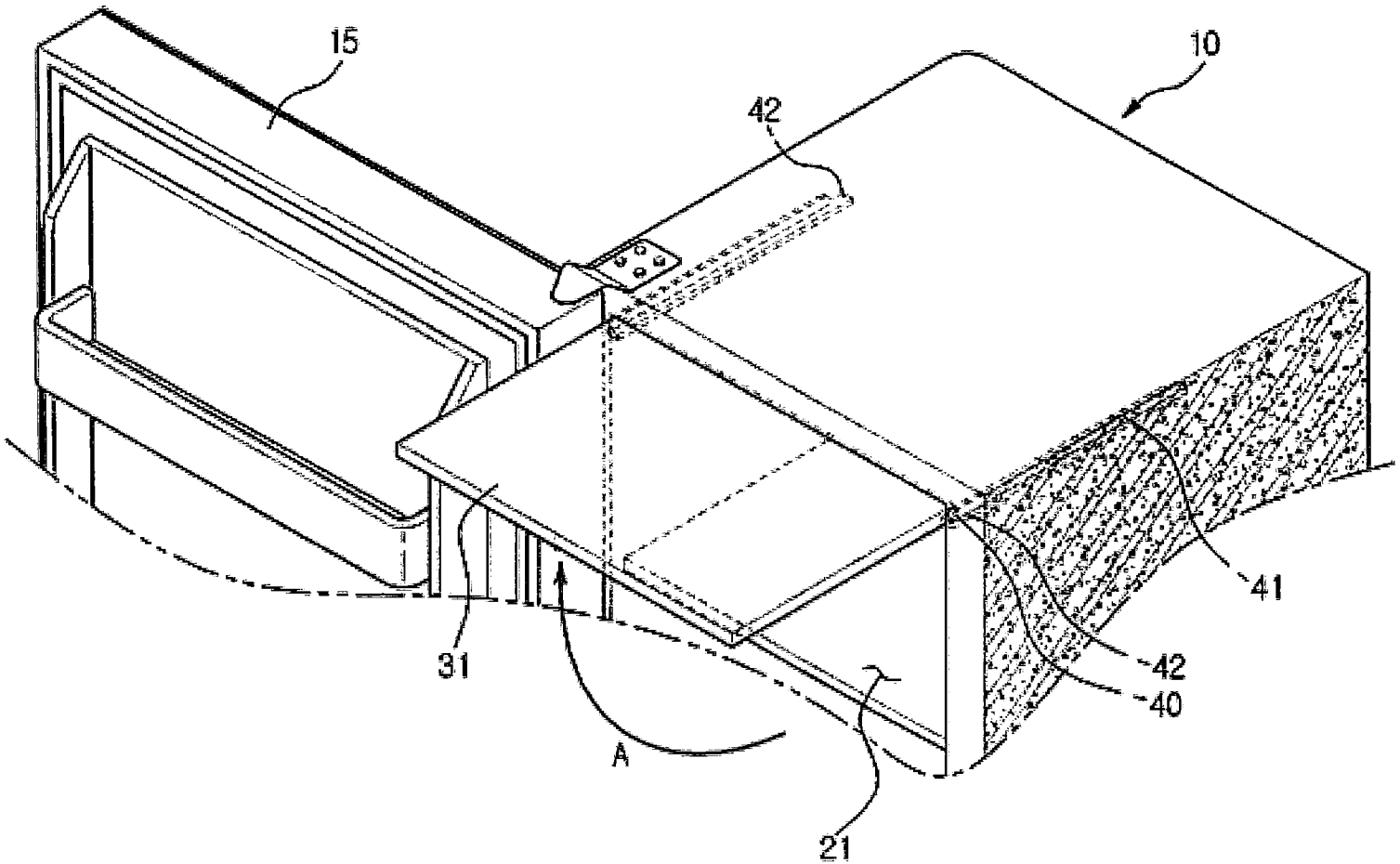
FIG. 4 is a perspective view of a portion of the refrigerator according to one embodiment of the present disclosure, in which the cool air cover is disposed.
Figure 5:
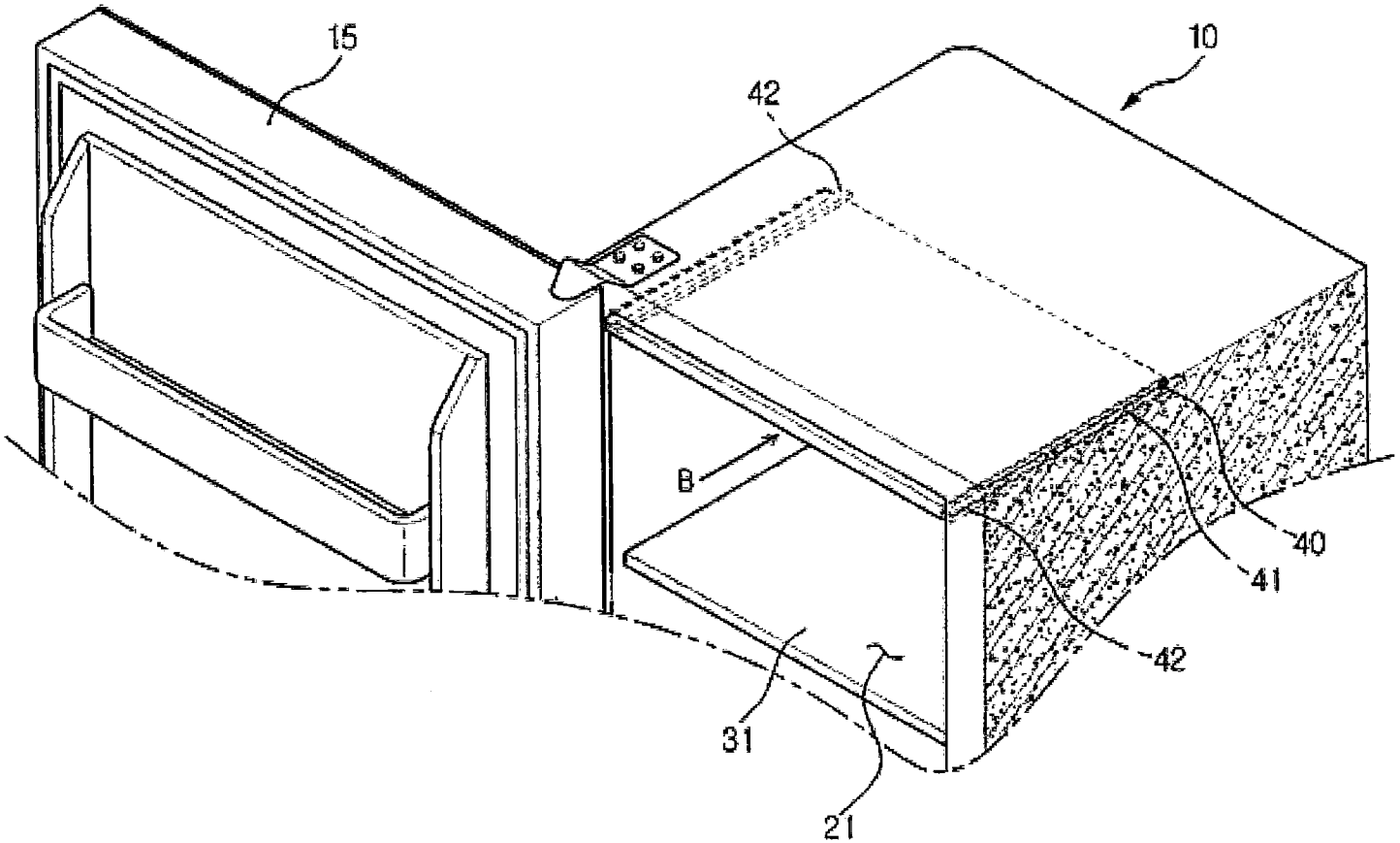
FIG. 5 is a perspective view illustrating a state in which the cool air cover of the refrigerator according to one embodiment of the present disclosure has slid to a retracted position.

FIG. 4 is a perspective view of a portion of the refrigerator according to one embodiment of the present disclosure, in which the cool air cover is disposed. FIG. 5 is a perspective view illustrating a state in which the cool air cover of the refrigerator according to one embodiment of the present disclosure has slid into a retracted position.

Referring to FIG. 4 and FIG. 5, a structure of the cool air cover 31 will be described in detail. As shown in FIG. 4, the cool air cover 31 has pivotal shafts 40 at both upper ends and hence rotates around an upper end of the storage compartment 21. Accordingly, the cool air cover 31 rotates in an "A" direction to open the storage compartment 21. Thus, food may be received in the storage compartment 21 in an open state.

As shown in FIG. 5, left and right guide grooves 41 are respectively formed in left and right sides of an upper end portion of the inner case forming the storage compartment 21 in a front-back direction so that the pivotal shaft 40 of the cool air cover 31 is inserted into the grooves 41 and slides along the grooves 41. Left and right cool air cover support portions 42 are formed to respectively protrude from left and right sides of the inner case forming the storage compartment 21 beneath the left and right guide grooves 41 so that the cool air cover 31 is slidably supported on the left and right cool air cover support portions 42.

Thus, after rotating upwards, the cool air cover 31 may slide on the cool air cover support portions 42 in a "B" direction into a retracted position. This rotation and slide configuration for the cool air cover 31 may be applied to a cool air cover 32 for the second uppermost storage compartment 22.

Figure 6:
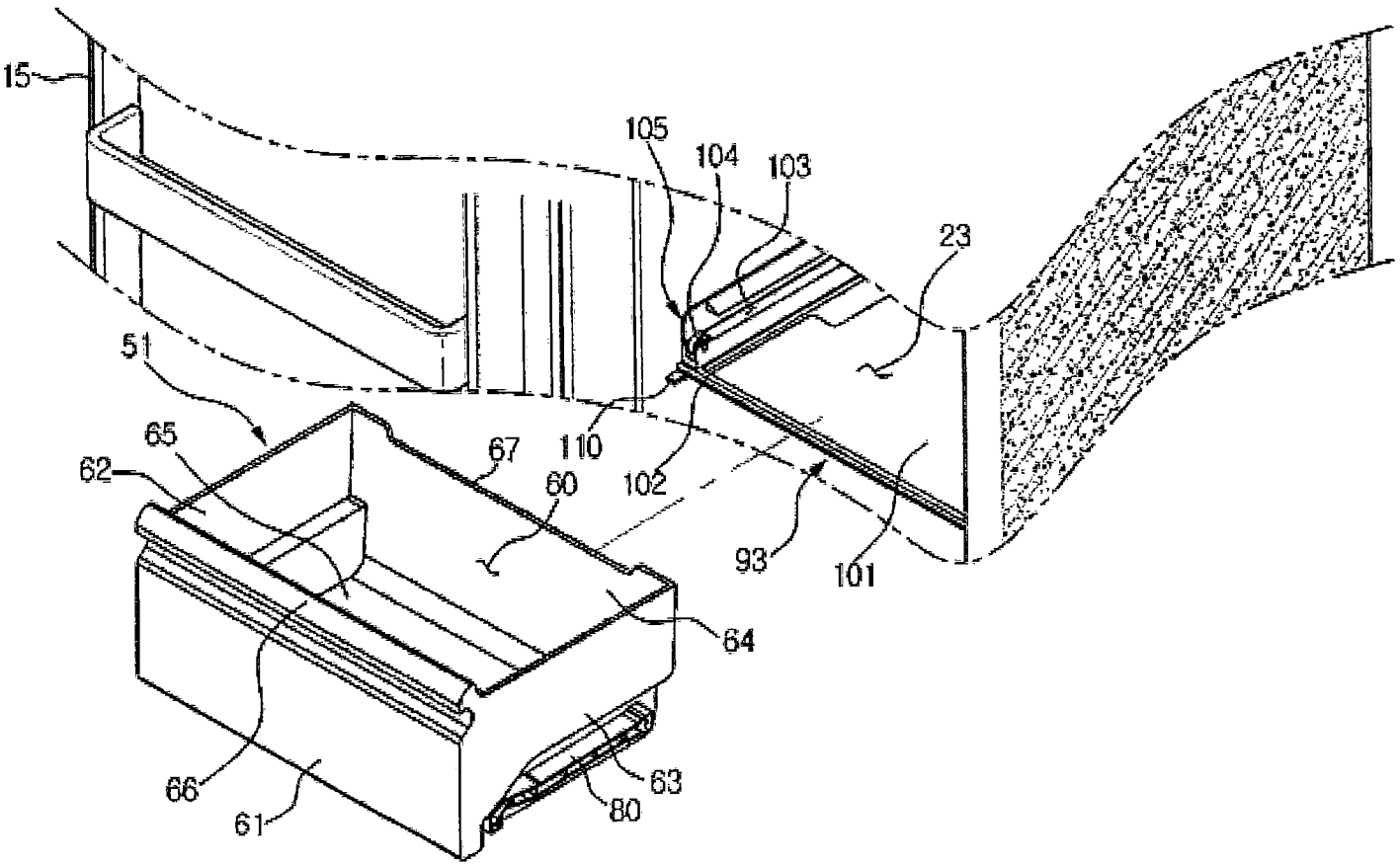
FIG. 6 is a perspective view of a portion of the refrigerator according to one embodiment of the present disclosure, in which a storage box is disposed.
Figure 7:
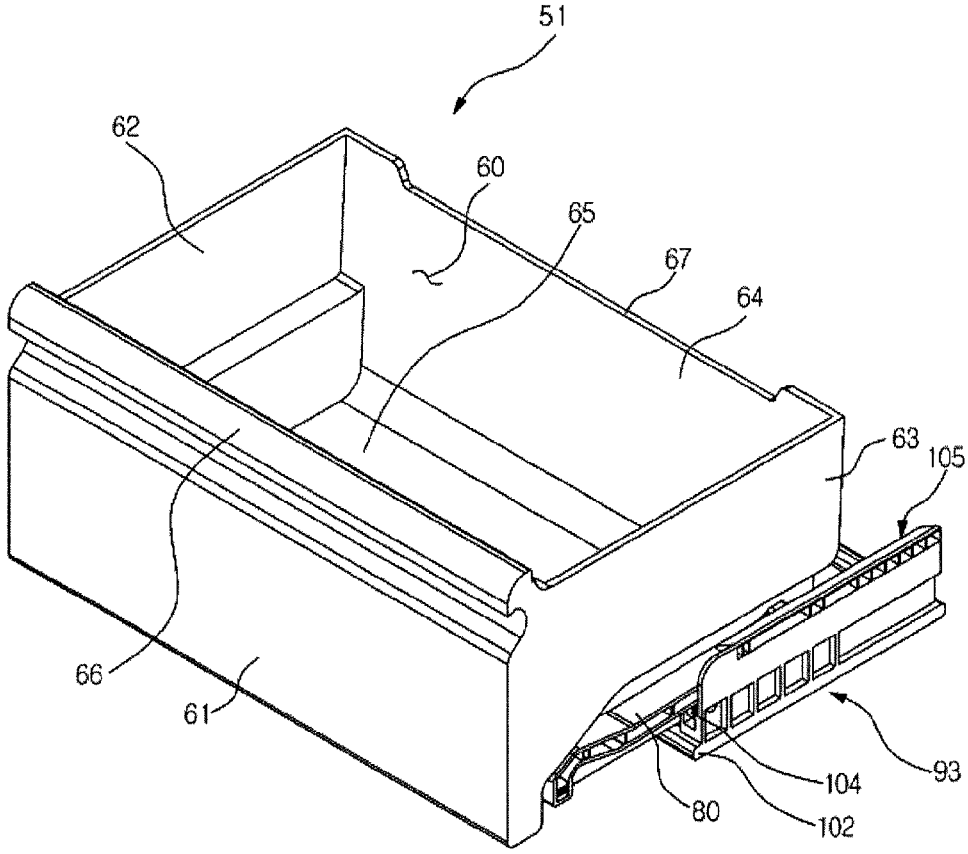
FIG. 7 is a perspective view illustrating a state in which the storage box and a shelf of the refrigerator according to one embodiment of the present disclosure are engaged with each other.
Figure 8:
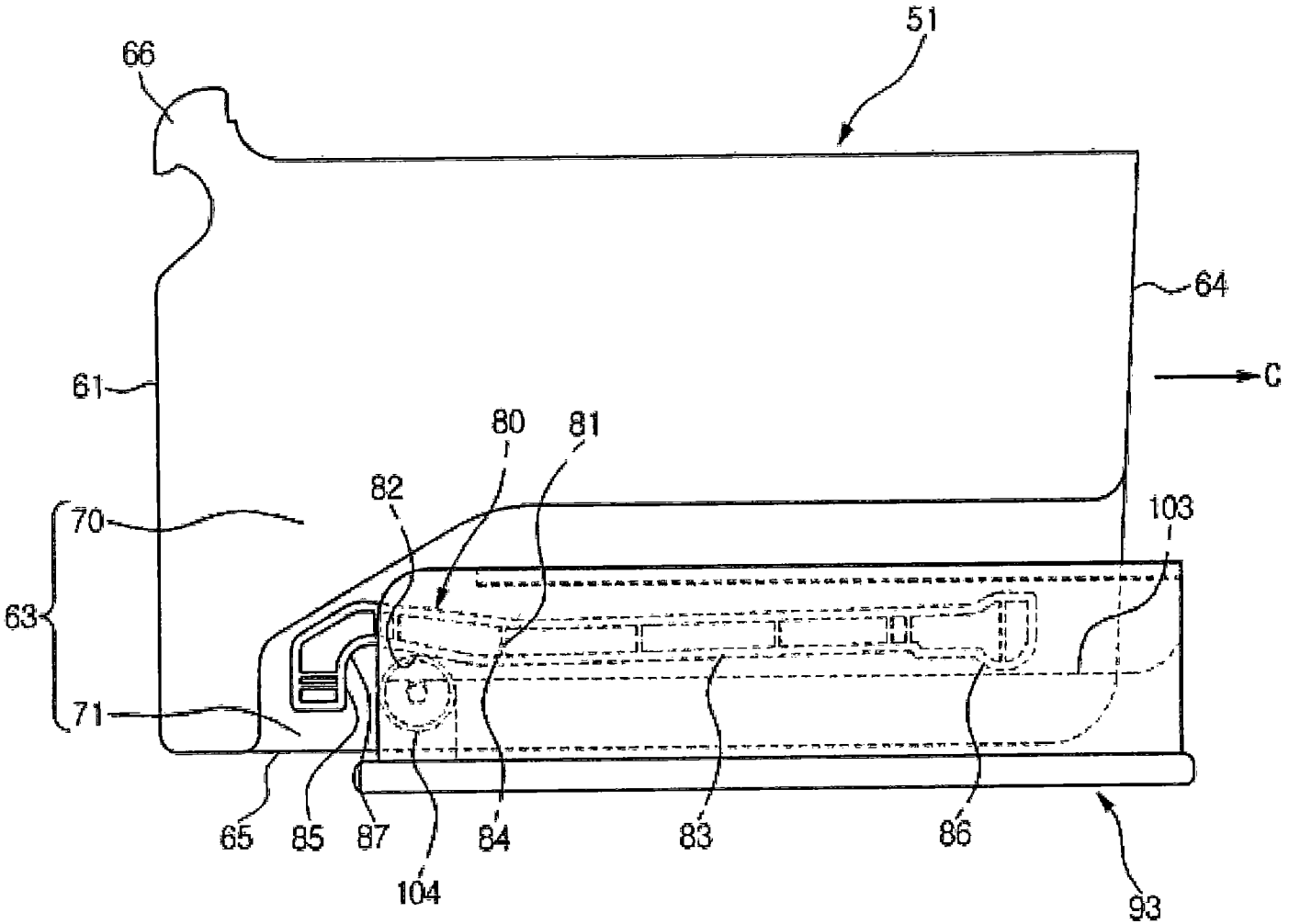
FIG. 8 is a side elevation view illustrating a state in which the storage box of the refrigerator according to one embodiment of the present disclosure is in a retracted position.
Figure 9:
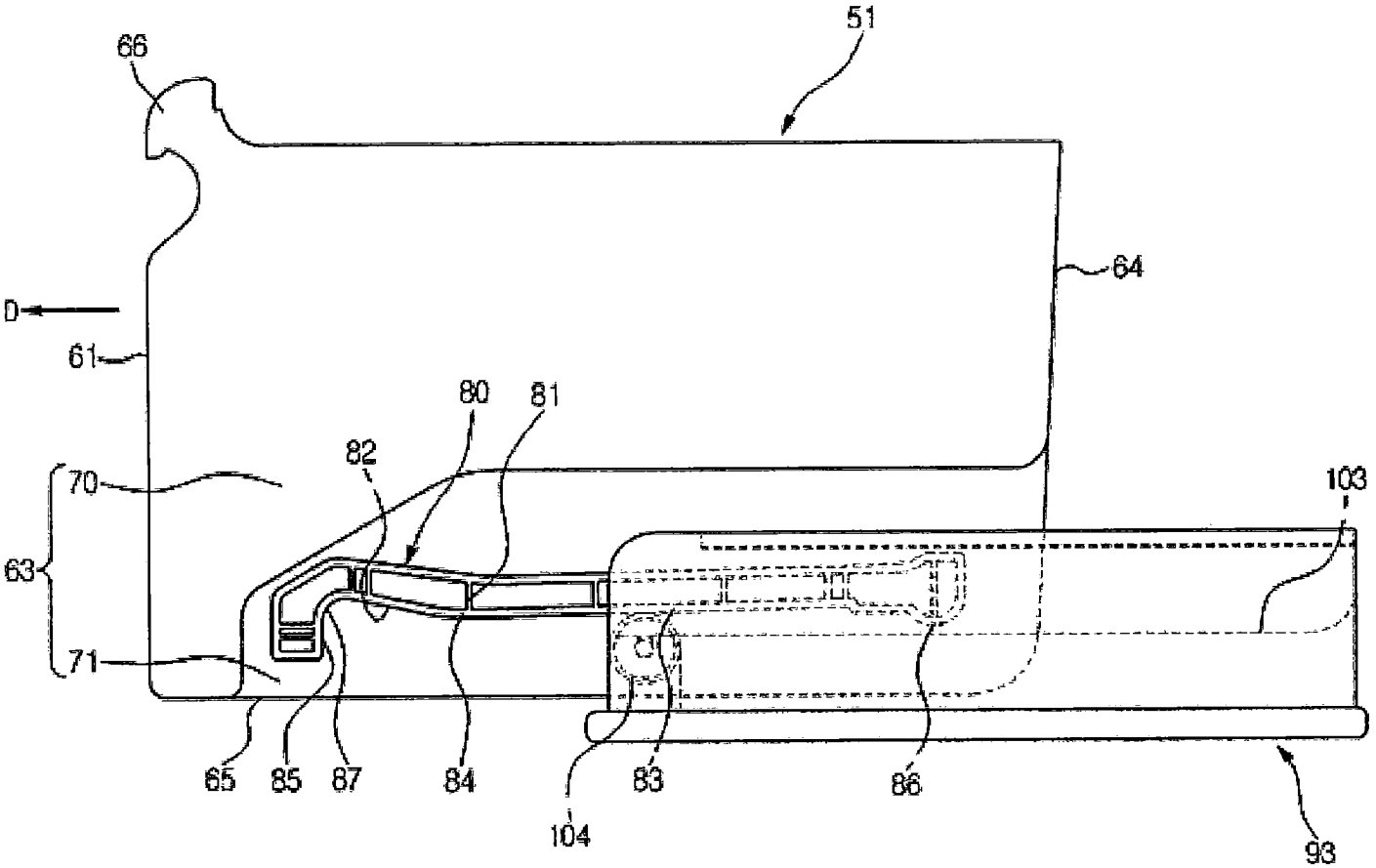
FIG. 9 is a side elevation view illustrating a state in which the storage box of the refrigerator according to one embodiment of the present disclosure moves toward an extended position.
Figure 10:
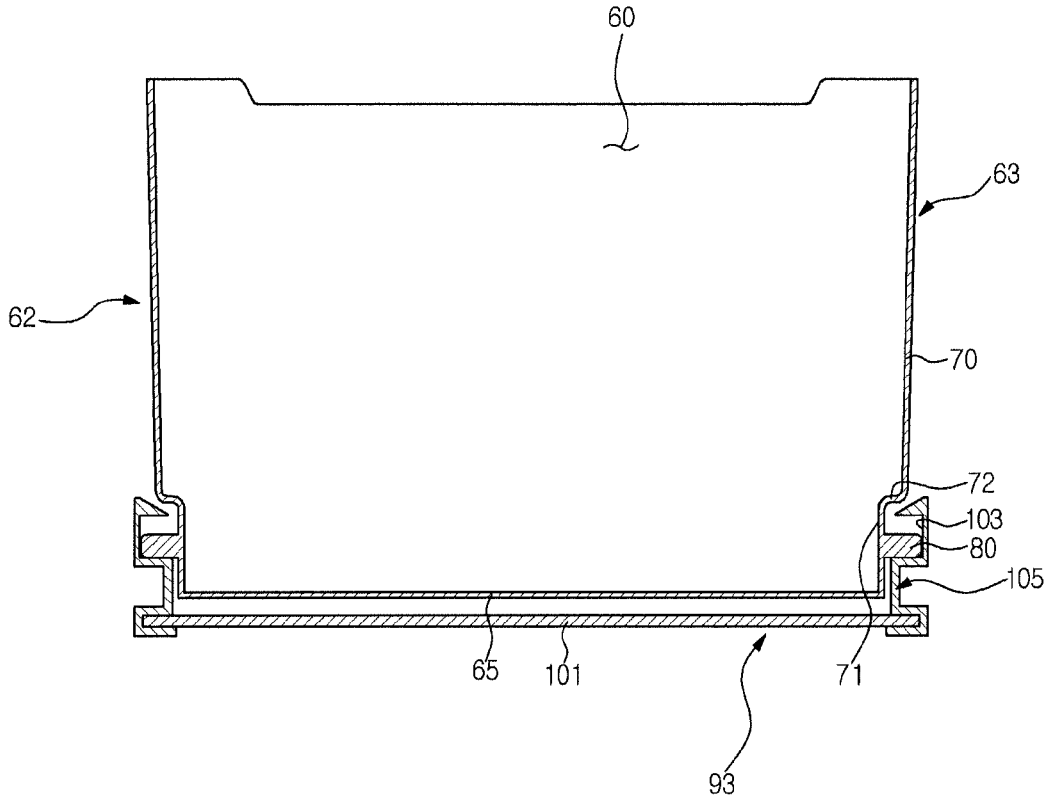
FIG. 10 is a front elevation view illustrating a state in which the storage box and the shelf of the refrigerator according to one embodiment of the present disclosure are engaged with each other.

FIG. 6 is a perspective view illustrating a portion of the refrigerator according to one embodiment of the present disclosure in which a storage box is disposed. FIG. 7 is a perspective view illustrating a state in which the storage box and a shelf of the refrigerator according to one embodiment of the present disclosure are engaged with each other. FIG. 8 is a side elevation view illustrating a state in which the storage box of the refrigerator according to one embodiment of the present disclosure is in a retracted position. FIG. 9 is a side elevation view illustrating a state in which the storage box of the refrigerator according to one embodiment of the present disclosure moves toward an extended position. FIG. 10 is a front elevation view illustrating a state in which the storage box and the shelf of the refrigerator according to one embodiment of the present disclosure are engaged with each other.

Hereinafter, configurations of the storage box 51, 52, 53, 54 or 55 and the shelf 93, 94, 95 or 96 according to one embodiment of the present disclosure will be described. The storage boxes 51, 52, 53, 54 and 55 have substantially the same configuration as one another and thus only a configuration of the storage box 51 will be described. Moreover, the shelves 93, 94, 95 and 96 have substantially the same configuration as one another and thus only a configuration of the shelf 93 will be described.

As shown in FIG. 6 to FIG. 10, the storage box 51 may have a substantially hexahedral shape having an open top and an inner space 60 formed therein. The storage box 51 a front wall 61, a left side wall 62, a right side wall 63, a rear wall 64 and a bottom 65.

The storage box 51 may be formed using injection molding. The storage box 51 has a grip portion 66 formed at the front wall 61. The grip portion 66 may be formed to be integrated with the storage box 51 via a transformation core using injection molding. The front wall 61 has an indentation forming the grip portion 66 as shown in FIG. 9.

The front wall 61 of the storage box 51 has an area substantially equal to an area of the front of the storage compartment 23 (refer to FIG. 3) of the storage chamber 13. Therefore, when the storage box 51 is in a retracted position in the storage compartment 23, cool air in the inner space 60 of the storage box 51 is prevented from being discharged to the outside thereof.

The rear wall 64 of the storage box 51 has an open portion 67 to allow cool air to flow into the inner space 60 of the storage box 51. That is, the rear wall 64 of the storage box 51 has a height less than that of the front wall 61 of the storage box 51.

The storage box 51 has left and right slide protrusions 80 respectively protruding from left and right side walls 62 and 63 and extending a long distance in a front-rear direction. Thus, via the left and right slide protrusions 80, the storage box 51 may slide toward between a retracted position and an extended position in and out of the storage compartment 23.

As shown in FIG. 10, each of the left and right side walls 62 and 63 of the storage box 51 includes a first wall portion 70 and a second wall portion 71. The first wall portion 70 is disposed above the second wall portion 71. The first wall portion 70 and the second wall portion 71 are connected to each other via a substantially horizontal connection wall portion 72.

The second wall portion 71 is disposed at a more inner position in the storage box 51 than the first wall portion 72. The left and right slide protrusions 80 of the storage box 51 respectively protrude from the second wall portions 71 of the left and right side walls 62 and 63. The first wall portion 70, the horizontal connection wall portion 72, the second wall portion 71 and the slide protrusion 80 of each of the left and right side walls 62 and 63 may be formed in an integrated manner via a transformation core using injection molding.

Accordingly, using a simple manufacturing method of the storage box according to one embodiment of the disclosure, it may be possible to produce a storage box 51 having a more ample inner space 60 than using a conventional method. In FIG. 10, reference numeral 105 indicates each of the left and right protrusion-receiving shelf portions, which include a slide groove 103 of the shelf 93 to receive the slide protrusion 80 of the storage box 51. The slide groove 103 includes left and right slide grooves. Details of the protrusion-receiving portions 105 will be described later.

As shown in FIG. 8 and FIG. 9, each of the left and right slide protrusions 80 of the storage box 51 includes a plurality of ribs 81 disposed to be spaced from each other in an extension direction of the protrusion 80 to secure improved rigidity, and inclined portions 82 and 83 to allow the storage box 51 to move depending on whether the storage box 51 is to be in a retracted state or an extended state.

The inclined portions 82 and 83 are formed as a lower portion of the slide protrusion 80. The inclined portions include a first inclined portion 82 and a second inclined portion 83 which are distinct from each other via a balance point 84. The balance point 84 is located at a position nearer the front of the storage box 51 than the rear of the storage box 51. The first inclined portion 82 inclines downward from a front side of the storage box 51 to a rear side thereof, while the second inclined portion 83 inclines upward from a front side of the storage box 51 to a rear side thereof. The balance point 84 is at the lowest position of the slide protrusion 80.

The shelf 93 has left and right rollers 104 to respectively support the left and right slide protrusions 80 while allowing the left and right slide protrusions 80 to smoothly slide thereon. Via the first and second inclined portions 82 and 83, the storage box 51 gradually moves downwards in drawing the storage box 51 in a front direction, while the storage box 51 gradually moves downwards in pushing the storage box 51 in a rear direction. Therefore, a user can easily manipulate the storage box 51.

That is, when the first inclined portion 82 of the storage box 51 is in contact with and supported on the roller 104, the storage box 51 gradually moves downwards as the storage box 51 is being pushed in a rear direction "C" as shown in FIG. 8. On the other hand, when the second inclined portion 83 of the storage box 51 is in contact with and supported on the roller 104, the storage box 51 gradually move downwards as the storage box 51 is being drawn in a front direction "D" as shown in FIG. 9.

The first inclined portion 82 may be more sloped than the second inclined portion 83. One of the first inclined portion 82 and the second inclined portion 83 may be eliminated from the slide protrusion 80. In other words, only one of the first inclined portion 82 and the second inclined portion 83 may be present at the slide protrusion 80.

As shown in FIG. 8 and FIG. 9, the slide protrusion 80 may further include a first stopper 85 to limit a retracted distance of the storage box 51 and a second stopper 86 to limit an extended distance of the storage box 51.

The first stopper 85 is formed at a front side of the slide protrusion 80 while being curved downwards from the first inclined portion 81. When pushing the storage box 51 in the rear direction, the first stopper 85 encounters and interferes with the roller 104 and thus movement thereof is stopped. In this way, the first stopper 85 limits the retracted distance of the storage box 51.

The second stopper 86 is formed at a rear side of the slide protrusion 80. When drawing the storage box 51 in the front direction, the second stopper 86 encounters and interferes with the roller 104 and thus movement thereof is stopped. In this way, the second stopper 86 limits the extended distance of the storage box 51. A user may completely remove the storage box 51 from the storage compartment 23 by slightly lifting up a rear end of the storage box 51 so as to be disengaged from the second stopper 86 and drawing the storage box 51 in the front direction in the lifted-up state of the rear end.

A round portion 87 having a gentle curvature is formed between the first stopper 85 and the first inclined portion 82 of the slide protrusion 80. Therefore, when the storage box 51 is brought into a maximum-retracted state in the storage compartment 23, the roller 104 of the shelf 93 is seated on the round portion 87, thereby preventing the storage box 51 from shaking.

As shown in FIG. 6, the shelf 93 includes a flat support structure 101, left and right frames 102 respectively provided along left and right edges of the support structure 101 to support the same, and the left and right protrusion-receiving shelf portions 105 respectively extending upwards from the left and right frame 102. The support structure 101 may be made of a glass material. The left and right protrusion-receiving shelf portions 105 may be respectively integrated with the left and right frames 102 as shown in FIG. 10. The left and right protrusion-receiving shelf portions 105 may also be respectively integrated with the support structure 101 as well as the left and right frames 102. Alternatively, the frames may be further provided at front and rear edges of the support structure 101 to encompass the support structure.

The left and right protrusion-receiving shelf portions 105 respectively have the left and right slide grooves 103 to respectively receive the left and right slide protrusions 80 of the storage box 51. At a front portion of each of the left and right protrusion-receiving shelf portions 105, the above-described roller 104 may be installed to allow the slide protrusion 80 of the storage box 51 to smoothly slide thereon. The shelf 93 may be supported by a pair of supports 110 provided at both sides of the inner case forming the storage compartment 23.

Figure 11:
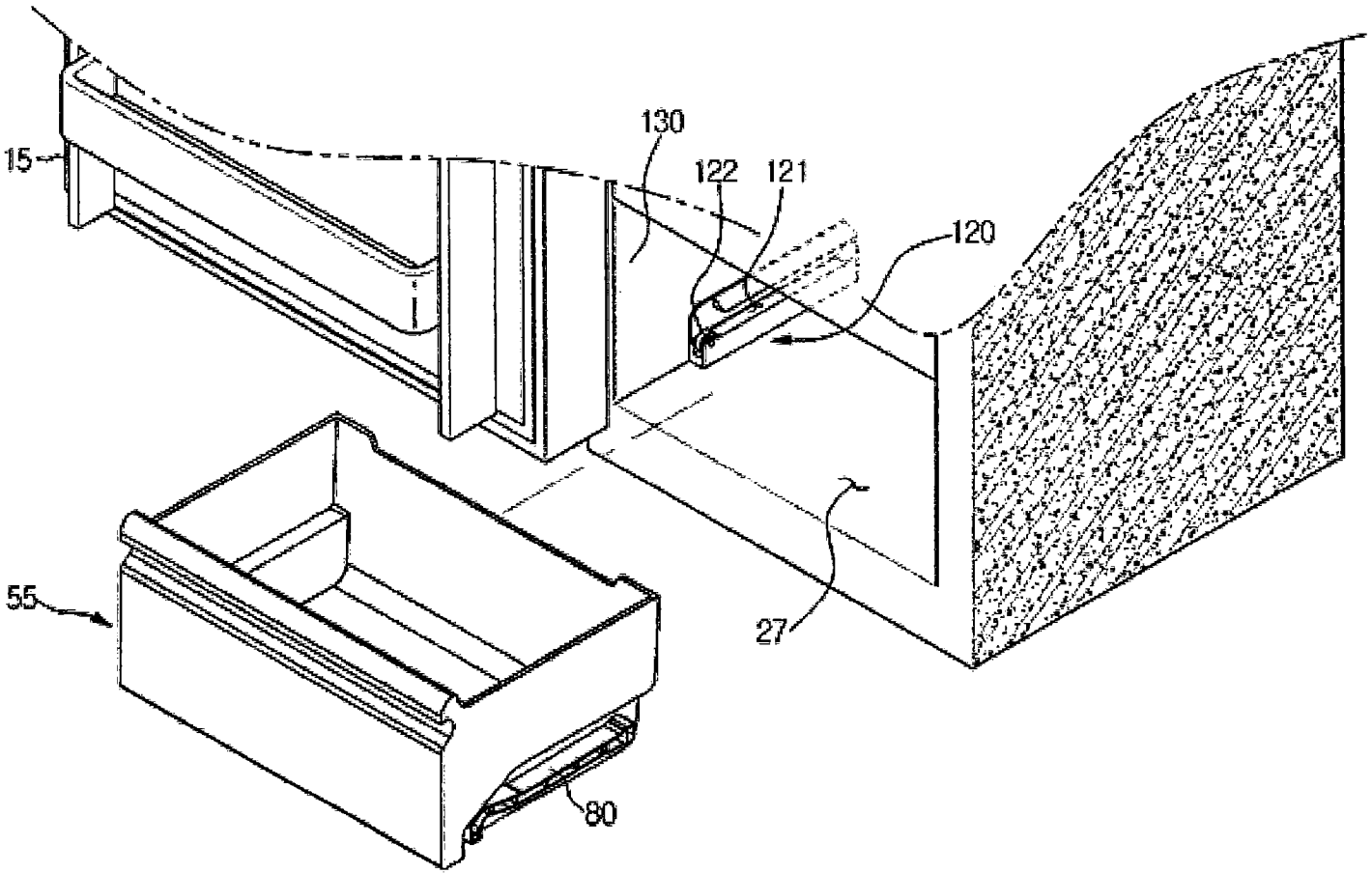
FIG. 11 illustrates a lowest storage compartment of the refrigerator according to one embodiment of the present disclosure, at which protrusion-receiving portions are provided.

FIG. 11 illustrates the lowest storage compartment of the refrigerator according to one embodiment of the present disclosure, at which protrusion-receiving units are provided.

As shown in FIG. 11, on left and right side faces of the lowest storage compartment 27 of the refrigerator according to one embodiment of the present disclosure, left and right separate protrusion-receiving units 120 are respectively installed to slidably support a storage box 55. The left and right separate protrusion-receiving units 120 may be respectively provided on left and right sides of the inner case 130 forming the lowest storage compartment 27.

In order to slidably support the storage box 55, each of the left and right separate protrusion-receiving units 120 may have a configuration corresponding to that of the above-mentioned protrusion-receiving shelf portion 105. That is, each of the left and right separate protrusion-receiving portions 120 may have a slide groove 121 extending a long distance in a front-rear direction to receive a slide protrusion 80 of the storage box 55, and a roller 122 to allow the slide protrusion 80 to smoothly slide thereon.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment defined in the body;

a door to open or close an open front of the storage compartment;

a storage box having an inner space to store food; and a shelf having a support structure to support food thereon, and protrusion-receiving shelf portions respectively extending along edges of both sides of the support structure and protruding from the support structure, wherein the storage box has slide protrusions respectively formed on both outer side-faces of the storage box at a lower portion thereof, and each of the protrusion-receiving shelf portions has a slide groove to receive the corresponding slide protrusion of the storage box, so that the storage box is able to be slidably mounted on or dismounted from the protrusion-receiving shelf portions of the shelf, wherein, when the storage box is mounted on the protrusion-receiving shelf portions of the shelf, food is put in the inner space of the storage box, whereby when the storage box is dismounted from the shelf, food is put on the support structure of the shelf, wherein each of both side walls of the storage box has a first wall portion and a second wall portion disposed under the first wall portion with a bent portion formed there between so that the second wall portion is disposed at a more inner position in the storage box than the first wall portion, wherein each of the slide protrusions of the storage box is formed on the outer side-face of the second wall portion, wherein a roller is provided at the protrusion-receiving shelf portion of the shelf to support the slide protrusion, wherein each of the slide protrusions of the storage box comprises a first inclined portion to allow the storage box to move downward as the storage box is pushed into the storage compartment, a second inclined portion to allow the storage box to move downward as the storage box is pulled out of the storage compartment and to move upward as the storage box is pushed into the storage compartment, and a balance point separating the first inclined portion and the second inclined portion, the balance point being located at a position nearer a front of the storage box than a rear of the storage box, and wherein the first inclined portion inclines downward from the front side of the storage box to the rear side of the storage box, while the second inclined portion inclines upward from the front side of the storage box to the rear side of the storage box.

2. The refrigerator according to claim 1, wherein the first inclined portion forms a front portion of the slide protrusion, while the second inclined portion forms a rear portion of the slide protrusion.

3. The refrigerator according to claim 1, wherein each of the slide protrusions of the storage box comprises a first stopper formed at a front end thereof so as to interfere with the roller installed at the shelf to limit a retracted distance of the storage box.

4. The refrigerator according to claim 1, wherein each of the slide protrusions of the storage box comprises a round portion to prevent the storage box from shaking after the storage box is brought into a maximum-retracted position in the storage compartment.

5. The refrigerator according to claim 1, wherein each of the slide protrusions of the storage box comprises a second stopper formed at a rear end thereof so as to interfere with the roller installed at the shelf to limit an extended distance of the storage box.

6. The refrigerator according to claim 1, wherein the storage box comprises a front wall, a rear wall, two side walls, and a bottom, wherein an indentation forming a grip portion is formed at the front wall, wherein the slide protrusions to enable sliding of the storage box are respectively formed on both side walls, and wherein the front wall, rear wall, both side walls, and bottom are formed to be integrated with one another using a single material by injection molding.

7. The refrigerator according to claim 1, wherein the shelf is seated and supported on a pair of supports respectively provided at both sides of an inner case of the storage compartment.

8. A refrigerator comprising:

a body;

a storage compartment defined in the body;

a door to open or close an open front of the storage compartment;

a shelf disposed in the storage compartment; and a storage box having an inner space to store food, wherein each of two side walls of the storage box comprises first and second wall portions, the second wall portion being disposed at a more inner position in the storage box than the first wall portion, wherein slide protrusions to enable sliding of the storage box are respectively formed on outer side-faces of both of the second wall portions of the storage box, wherein protrusion-receiving units are respectively provided on both inner side-faces of the storage compartment to respectively receive the slide protrusions of the storage box, wherein a roller is provided at the protrusion-receiving unit to support the slide protrusion, wherein each of the slide protrusions of the storage box comprises a first inclined portion to allow the storage box to move upward as the storage box is pulled out of the storage compartment and to move downward as the storage box is pushed into the storage compartment, a second inclined portion to allow the storage box to move downward as the storage box is pulled out of the storage compartment and to move upward as the storage box is pushed into the storage compartment, and a balance point separating the first inclined portion and the second inclined portion, the balance point being located at a position nearer a front of the storage box than a rear of the storage box, and wherein the first inclined portion inclines downward from the front side of the storage box to the rear side of the storage box, while the second inclined portion inclines upward from the front side of the storage box to the rear side of the storage box.

9. The refrigerator according to claim 8, wherein the first wall portion is disposed above the second wall portion, and wherein a connection wall portion is formed between the first and second wall portions.

10. The refrigerator according to claim 8, wherein each of both the side walls of the storage box has a bent portion.

* * * * *

UNITED STATES PATENT AND TRADEMARK OFFICE

CERTIFICATE OF CORRECTION

PATENT NO. : 8,882,211 B2
APPLICATION NO. : 13/648683
DATED : November 11, 2014
INVENTOR(S) : Myoung Jin Jang et al.

It is certified that error appears in the above-identified patent and that said Letters Patent is hereby corrected as shown below:

On the title page

Column 1, Item [30] (Foreign Application Priority Data), line 1, delete "10-2001-0104863" and insert -- 10-2011-0104863 --, therefor.

Signed and Sealed this
Second Day of June, 2015

Michelle K. Lee

Michelle K. Lee
*Director of the United States Patent and Trademark Office*